US005555972A

United States Patent [19]

Schwab

[11] Patent Number: 5,555,972

[45] Date of Patent: Sep. 17, 1996

[54] SELF-STRESSING SNAP SPRING ASSEMBLY FOR ELECTRICAL CONTACTS

[76] Inventor: Pierre P. Schwab, 1768 SE. Clearmont St., Port. St. Lucie, Fla. 34983

[21] Appl. No.: 526,110

[22] Filed: Sep. 8, 1995

[51] Int. Cl.[6] ..... H01H 5/22

[52] U.S. Cl. ..... 200/451; 200/407; 200/447; 200/448; 200/454

[58] Field of Search ..... 200/451, 407, 200/447, 448, 454, 449, 452, 458, 460

[56] References Cited

U.S. PATENT DOCUMENTS

| | | | |
|---|---|---|---|
| Re. 28,578 | 10/1975 | Burch et al. | 200/407 |
| 3,213,228 | 10/1965 | Burch et al. | 200/67 |
| 4,032,734 | 6/1977 | Burch | 200/67 |
| 4,424,506 | 1/1984 | Burch | 337/365 |
| 4,587,387 | 5/1986 | Piguet | 200/407 |
| 4,796,355 | 1/1989 | Burch et al. | 29/622 |

*Primary Examiner*—David J. Walczak

[57] ABSTRACT

An ultra high production snap acting switch includes a blanked sheet metal tab for providing extremely consistent and repeatable operation. The switch simply includes a sheet metal M-blade automatically spot welded (or riveted) to a sheet metal spring arm. The spring arm has an integral tab pressed between two flexible legs of the M-blade. The stress imparted by the tab accurately distorts the M-blade so that it assumes a very predictable bistable operation.

18 Claims, 6 Drawing Sheets

SELF-STRESSING SNAP SPRING ASSEMBLY FOR ELECTRICAL CONTACTS

BACKGROUND OF THE INVENTION

1. Field of the Invention

The subject invention generally pertains to snap springs and more specifically to those used in conjunction with electrical contacts.

2. Description of Related Art

Heretofore it has been well known to provide overcenter snap springs for electrical control devices such as thermostats and switches. Burch U.S. Pat. Nos. 3,213,228; 4,032,734; 4,424,506; and 4,796,355 disclose how to stress a flat, M-shaped spring member (M-blade) to become snap acting by spreading the inner legs of its U-shaped loops with an activating member, thus side-stressing the planar spring member and causing it to become snap acting and bistable.

The applicant of the present invention has designed, used, reduced to practice and commercialized numerous products using the M-blade for over 15 years and has become expert at Burch "M-blade" technology in the process. As a result of this work, the inventor of the present application has discovered and observed numerous limits to the operating of the M-blade, the remedy of which are the objects of this application for patent.

One such observation is the need to spread apart the inner leg portions of the M-blade spring member to insert the activating member (rivet, pin or screw) prior to stressing, thus slowing the assembly operation. For example, if a commercial rivet was to be used to accomplish the stressing, the rivet could not be inserted without first forcing the inner leg portions apart to allow passage for the rivet through the opening. In addition, the rivet and opening must be made to very close tolerances, as a small change in size will cause a large change in stress and consequently a large change in force required to snap the blade from one position into the other. Furthermore, the riveting process must be very closely monitored. Any excessive pressure and deformation in the area where the M-blade spring member is riveted to its spring arm will cause unwanted mechanical bias and non-uniform snap-action from assembly to assembly in production. Still further, the M-blade spring member may turn out of alignment if torque is applied to it, caused for example by shock or vibration. Further yet, the Burch invention combines stressing and attaching the M-blade spring member to a spring arm in one operation, thus preventing effective and separate control of each operation during the manufacturing process.

Subsequent Burch U.S. Pat. No. 4,796,355 attempts to overcome these limitations and disadvantages in providing an alternate method for stressing the M-blade spring member by compressing the outside legs of the U-shaped loops and locking them with a folded strip of metal welded to the spring member at each end of the folded strip. In practical use, as for example in an electrical switch, the folded strip of metal may need to be made from a suitable contact material such as a silver alloy. To conduct electrical current the M-blade snap acting spring member is made from copper alloy, due to its low resistivity. Experience with attempting to use the Burch invention has shown that welding such a folded precious metal strip to the conductive copper alloy presents difficulty in welding. To overcome these difficulties the folded precious metal strip may need to be made from a composite material which on the one side facilities welding and on the other side provides good electrical contact properties. The method for producing this snap-contact assembly, as envisioned by its inventors has proven to be difficult to achieve and prohibitive in cost.

A second observation is the flexing or bending of the M-blade spring member, particularly in the longitudinal plane, when force is applied to make it snap overcenter. As a result of this flexing, optimal snap action of the M-blade spring member is limited by its material thickness.

A third observation is the absence of anti-rotation means designed to prevent the M-blade spring member attached to the spring arm, to move out of position as a result of material expansion and contraction under combined and adverse environments such as temperature, vibration and shock.

A fourth observation is that the method of using a rivet, screw or other mechanical compression assembly means, for mounting and attaching the M-blade spring member to the spring arm can lead to an increase of the electrical resistance path between the M-blade spring member and the spring arm assembly when exposed for a long time to adverse environments and high temperatures as they are encountered in many industrial sites.

A fifth observation is the effect on the M-blade operating characteristics and its snap acting ability of the ratio existing between loop centers of the M-blade and distance from the loop centers to the anchor point at which the M-blade is attached to its supporting arm.

SUMMARY OF THE INVENTION

To avoid the limitations of existing snap spring devices, it is an object of the subject invention to provide a simple two-piece snap spring assembly comprising a double-loop spring member attached to a single-piece spring arm having an integral stress tab.

A second object is to provide a sheet metal spring arm having an integral stress tab that is accurately blanked to produce highly repeatable snap action.

A third object is to provide a snap-contact switch assembly with consistent uniform force and having a consistent repeatable performance over an extended period of life.

A fourth object is to provide a snap-contact that can be automatically assembled at high speed with conventional welding equipment or automated "pick-and-place" assembly machinery.

A fifth object is to provide an anti-rotation means, to prevent the M-blade spring member from moving out of alignment or rotate after assembly to its support (spring member or post).

A sixth object is to reduce the number of parts needed to operate the M-blade snap spring mechanism as described in the aforementioned Burch patents, thus achieving a lower cost to produce the assembly.

A seventh object is to provide a means for operating a plurality of M-blade spring members to operate and snap overcenter in unison.

An eighth object is to provide a means for "tuning" the M-blade spring member to adjust its natural frequency response to various vibration levels and snap acting capability by means of adjusting the ratio existing between loop centers of the M-blade and distance from the loop centers to the anchor point at which the M-blade is attached to its supporting arm.

A ninth object is to stiffen an M-blade spring member along its outer edges to minimize flexing, warping, and bowing as force is applied to make it snap, thus allowing the use of thinner and more flexible materials.

These and other objects of the invention are provided by a novel snap spring that includes an M-shaped blade and a single-piece spring arm having an integral stress tab. The blade attaches to the spring arm at an anchor point and the tab stresses the blade at a stress point that is spaced apart from the anchor point.

DESCRIPTION OF THE PREFERRED EMBODIMENT

Figure 1:
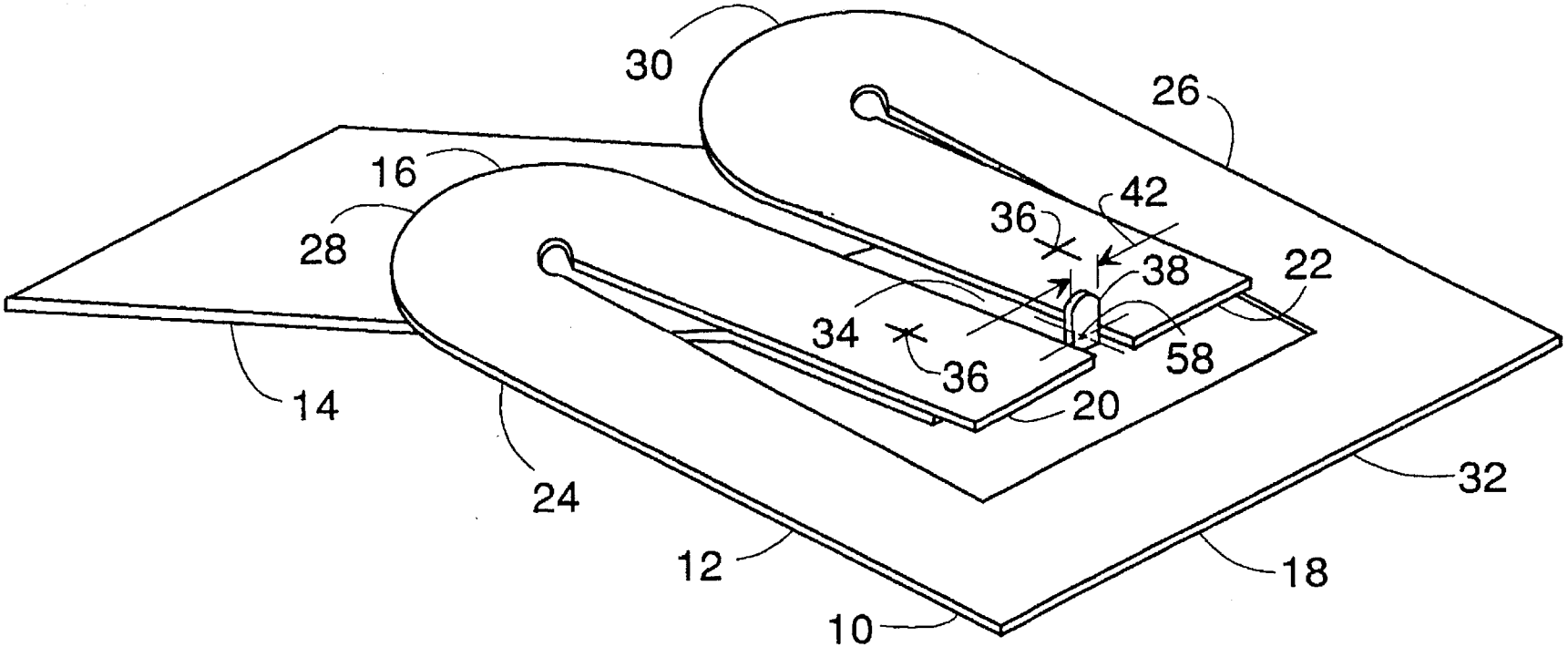
FIG. 1 is a perspective view of an auto-snap device according to the subject invention.

Referring to FIG. 1, a snap spring 10 comprises a sheet metal spring member 12 and a sheet metal spring arm 14. The term "sheet metal" as used herein refers to any part that can be cut (e.g., a stamping operation) from a metal blank whose thickness is less than 20% of its width and height. Spring member 12 includes a double-loop end 16 that is opposite a closed end 18, and includes a first inner leg 20, a second inner leg 22, a first outer leg 24, and a second outer leg 26. A first loop 28 joins first inner leg 20 to first outer leg 24 at double-loop end 16. Likewise, a second loop 30 joins second inner leg 22 to second outer leg 26 at double-loop end 16. A cross member 32 joins outer legs 24 and 26 at closed end 18. Inner legs 20 and 22 are spaced apart from each other to define a gap 34.

Figure 2:
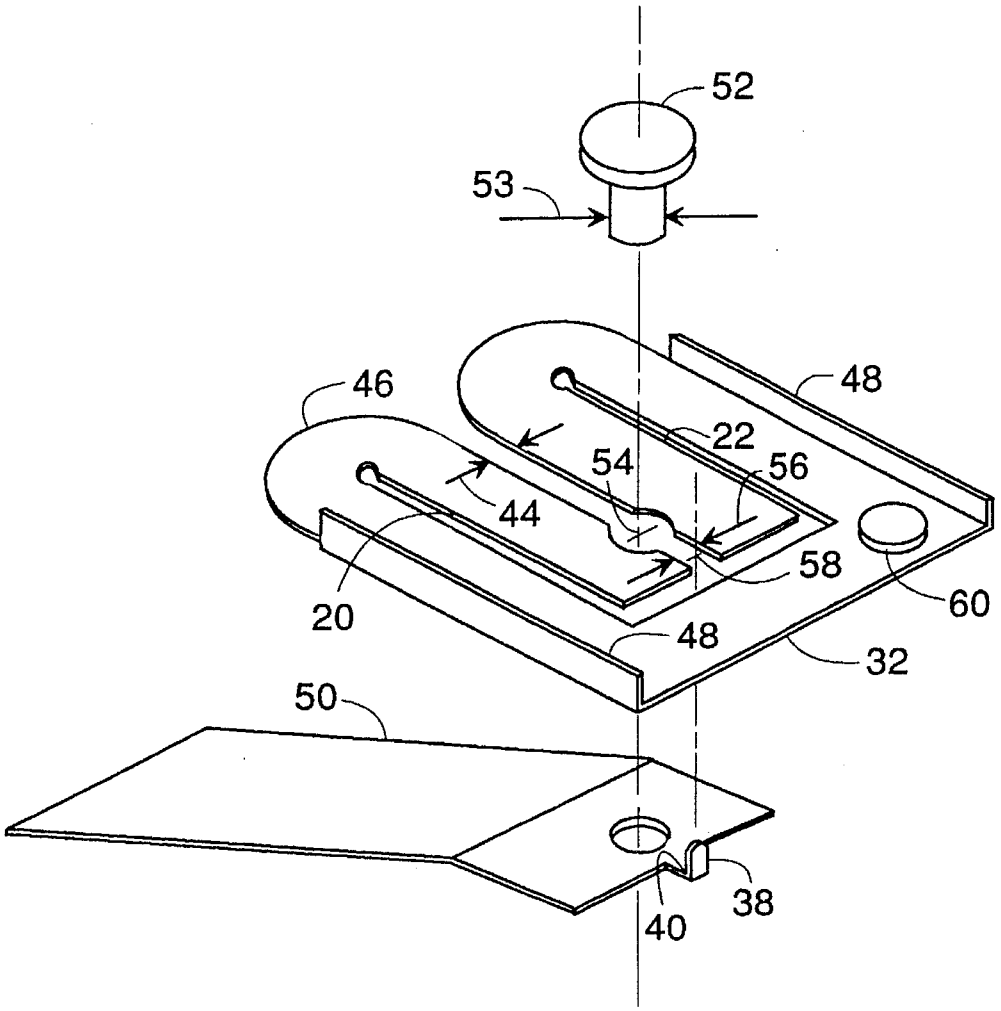
FIG. 2 is an exploded view of another embodiment of the auto-snap device.

Spring arm 14 includes an integral tab 38 that is bent out of coplanar alignment with adjacent portions of spring arm 14, thereby producing a crease 40 (FIG. 2). Tab 38 has a width 42 that is slightly larger than width 44 of gap 34 when spring member 12 is in an unassembled relaxed state, as shown in FIG. 2. In an assembled stressed state, as shown in FIG. 1, tab 38 is forced through gap 34 at stress point 58 to push inner legs 20 and 22 further apart, and spring arm 14 is spot welded to spring member 12 at anchor points 36. Pushing inner legs 20 and 22 further apart than they would otherwise be in a relaxed state distorts spring member 12 to assume a snap acting bistable operation. This snap acting bistable operation is explained in detail in U.S. Pat. Nos. 3,213,228; 4,032,734; 4,424,506; and 4,796,355 all of which are specifically incorporated by reference herein.

In one embodiment of the invention, width 42 of tab 38 is 0.080" and width 44 of gap 34 is 0.50" when spring member 12 is in an unassembled relaxed state. This combination forces inner legs 20 and 22 an additional 0.030" apart upon assembling snap spring 10. The length of spring member 12 from double-loop end 16 to closed end 18 is 0.75" and its total width between the outer edges of the two outer legs 24 and 26 is 0.63". In one embodiment of the invention, spring member 12 is 0.010" thick and is made of a H-hardenable beryllium copper alloy; however, stainless steel, as well as most any other spring-like material, would also work.

In the embodiment of FIG. 2, spring member 46 includes longitudinal ribs 48 for added rigidity and an electrical contact 60 is conductivity bonded to cross member 32 for adapting spring member 46 for use in an electrical switch assembly. One example of contact 60 is what is commonly referred to in the industry as contact tape, which is readily available commercially. In addition, spring arm 50 is attached to spring member 46 by way of a rivet 52 at an anchor point 54. The rivet's shank diameter 53 is small enough so that it does not spread the inner legs 20 and 22 apart once tab 38 is protruding through gap 56 at stress point 58. This allows the stressed bistable condition of spring member 46 to be predictably determined by an accurately stamped width of tab 38 rather than being determined by an inherently inaccurate diameter of a standard rivet 52.

For even greater predictability of the bistable spring action, the location of stress point 58 is positioned at the extremities of inner legs 20 and 22. Stress point 58 is situated between cross member 32 and anchor point 54. Another advantage of having stress point 58 spaced apart from anchor point 54 is to prevent spring arm 50 from rotating about anchor point 54.

Figure 3:
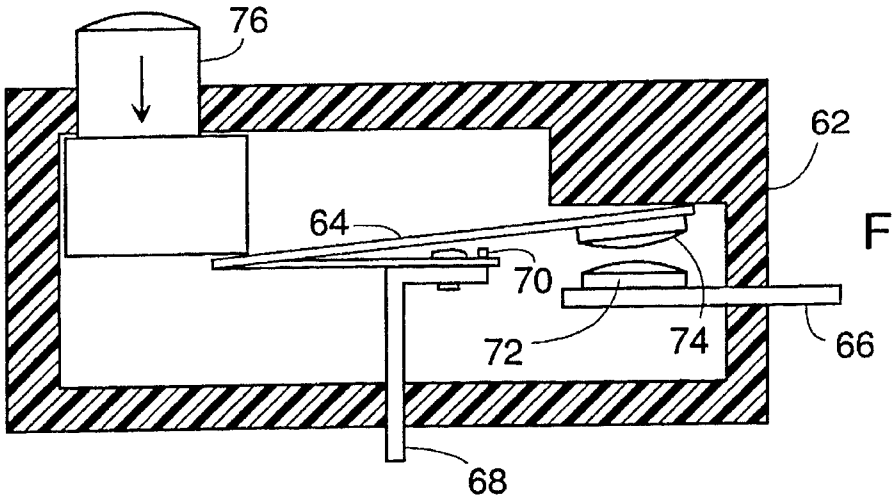
FIG. 3 is a cross-sectional view of a SPST switch actuated at the double-loop end of an auto-snap device.
Figure 5:
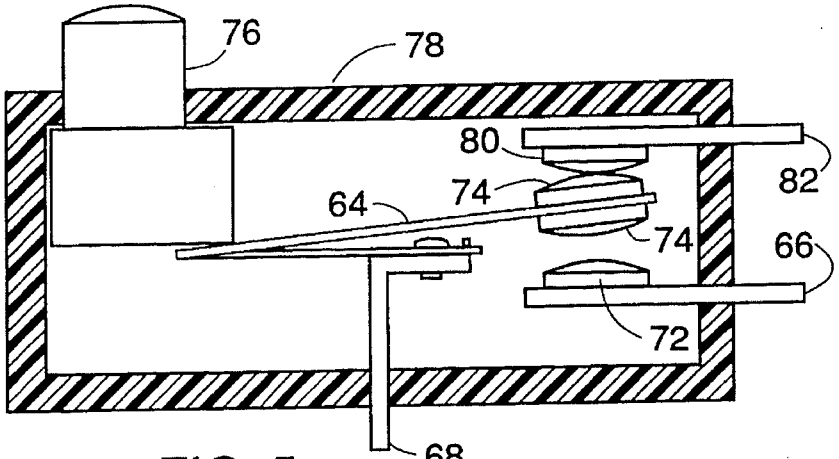
FIG. 5 is a cross-sectional view of a SPDT switch incorporating an auto-snap device.
Figure 4:
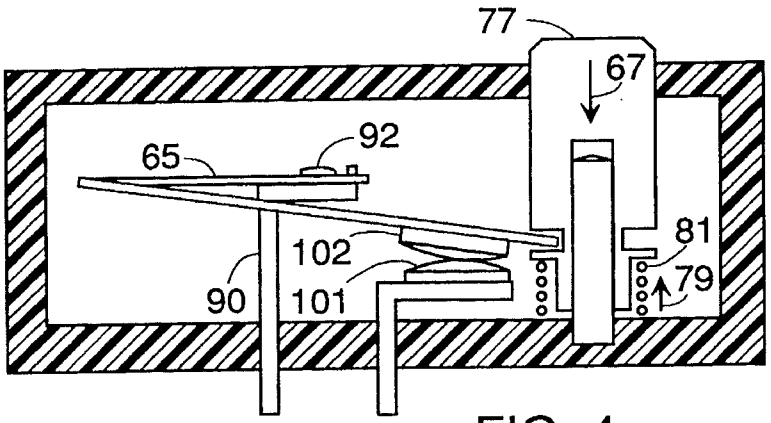
FIG. 4 is a cross-sectional view of a SPST switch actuated at the closed end of an auto-snap device.

The snap spring is primarily intended for use in an electrical switch. FIG. 3 shows a single-pole, single-throw (SPST) switch 62 incorporating a snap spring 64. Switch 62 includes two electrical terminals 66 and 68. Terminal 66 connects to a first contact 72 and terminal 68 is riveted to the inner legs of spring 64. Terminal 68 includes an integral tab 70 corresponding in function to tab 38 of FIG. 1. A second contact 74 is conductively bonded to the cross-member of spring 64. In other words, there is electrical continuity between contact 74 and spring 64. An actuator 76 acting upon the double-loop end of spring 64 causes the make and break of contacts 72 and 74. A spring return actuator 77 can also act upon the cross member of a spring 65 as shown in FIG. 4. An external force 67 pushes actuator 77 down and the return force 79 is provided by a compression spring 81. A single-pole, double-thrown (SPDT) switch 78 of FIG. 5 is provided by simply adding a third contact 80 with a corresponding terminal 82.

A double-pole, single-thrown (DPST) switch is produced by combining two SPST switches, of FIGS. 3 or 4, in tandem while sharing a single actuator. Likewise, a double-pole, double-throw (DPDT) switch is produced by combining two SPDT switches (e.g., FIG. 5) in tandem.

Figure 6:
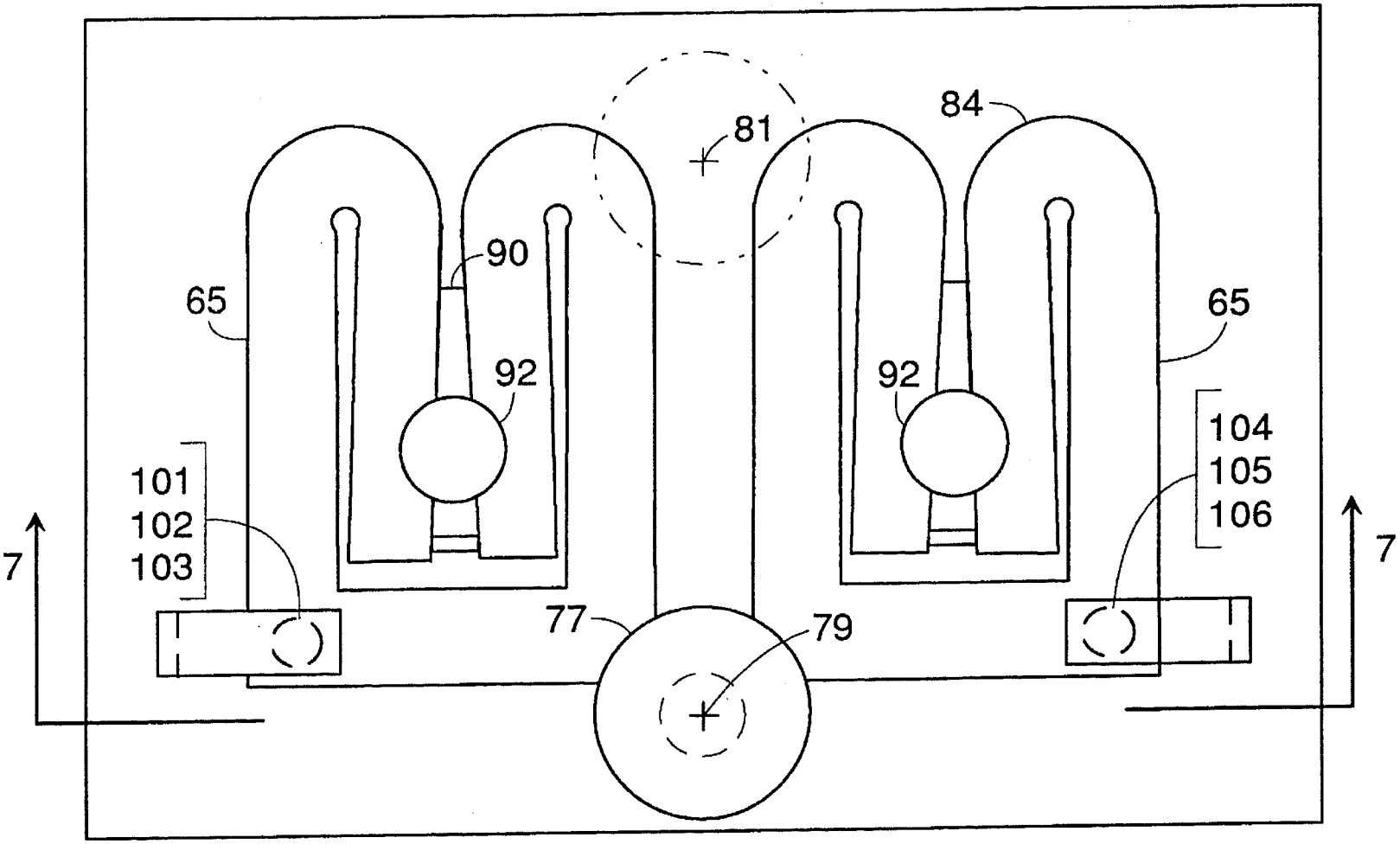
FIG. 6 is a top view of a dual auto-snap device.
Figure 7:
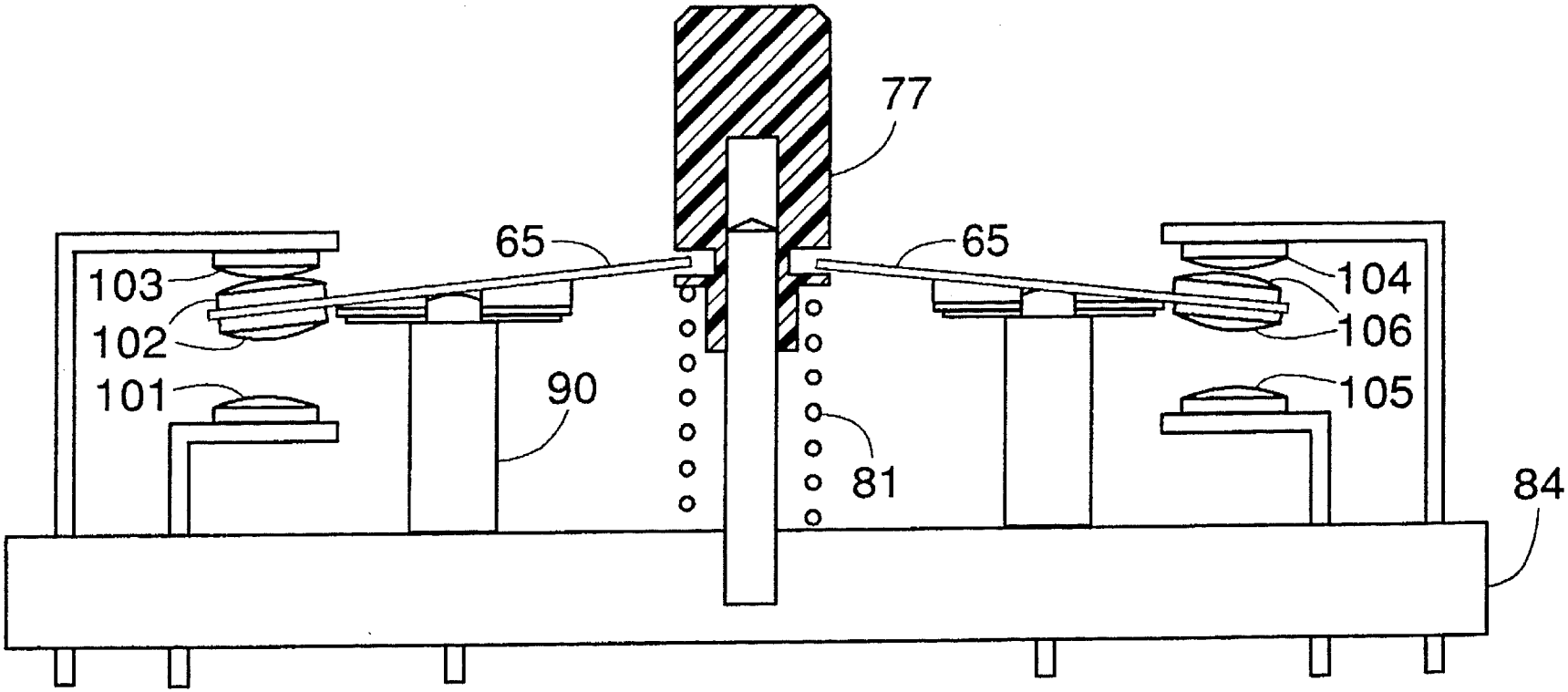
FIG. 7 is a cross-sectional view of FIG. 6.

For example, the DPDT switch 84 of FIGS. 6 and 7 includes two snap springs 65, actuator 77, spring arm 90, rivets 92, a first contact 101, a second contact 102, a third contact 103, a fourth contact 104, a fifth contact 105, and a sixth contact 106. Contacts 102 and 106 are conductively bonded to their respective spring 65.

Up and down movement of actuator 77 provides a means for selectively and alternately engaging contacts 102 with contacts 101 and 103 and also contacts 106 with contacts 104 and 105.

Eliminating or isolating contacts 103 and 104 of FIGS. 6 and 7 changes DPDT switch 84 to a DPST switch.

A variation of switch 84 would be to relocate actuator 77 from point 79 to 81 and have actuator 77 act upon the double loop ends of spring members 65.

Figure 8:
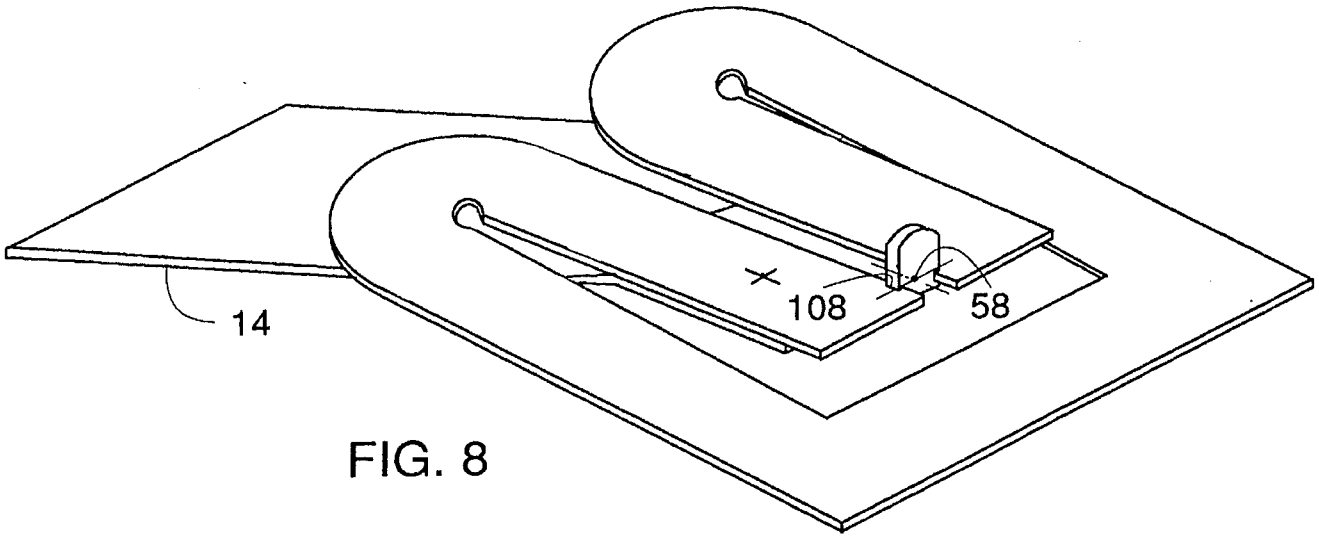
FIG. 8 shows a spring member having a double-sided locating recess.
Figure 9:
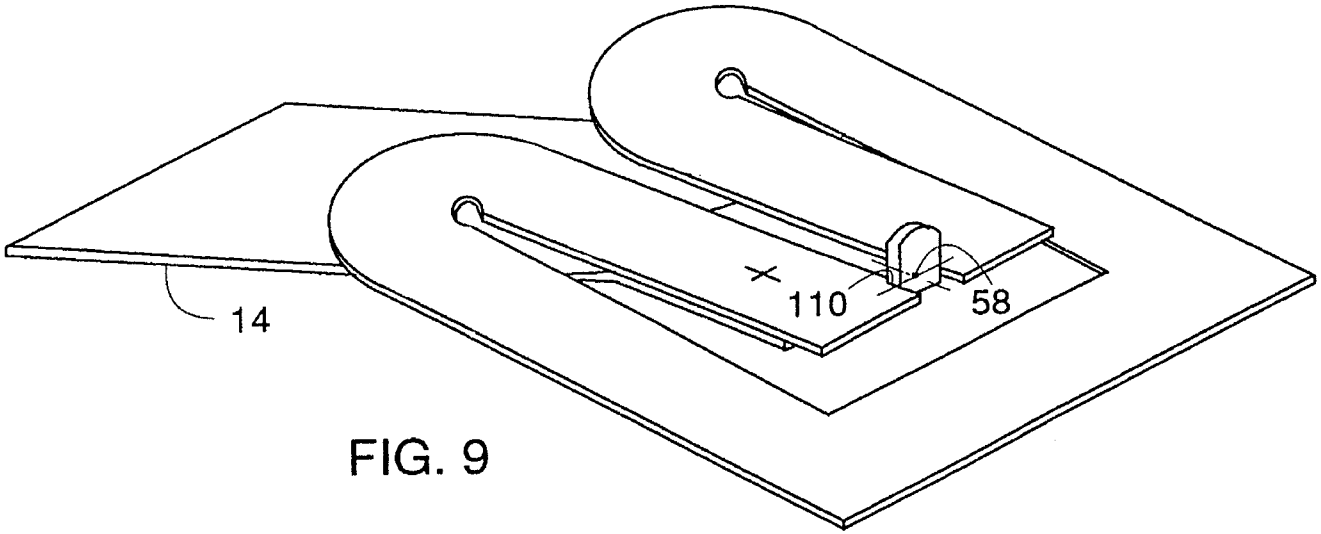
FIG. 9 shows a spring member having a single-sided recess.

An improvement of the snap spring involves adding a double-sided locating recess 108 as shown in FIG. 8. This helps in positioning tab 38 during assembly. Recess 110 of FIG. 9 illustrates a single-sided design.

Although the invention is described with respect to a preferred embodiment, modifications thereto will be apparent to those skilled in the art. Therefore, the scope of the invention is to be determined by reference to the claims which follow.

I claim:

1. An auto-snap device, comprising:

a sheet metal spring member having a double-loop end opposite a closed end, said spring member having a first outer leg, a second outer leg, a first inner leg, a second inner leg, and a cross member, said first outer leg coupled to said first inner leg by way of a first loop at said double-loop end, said second outer leg coupled to said second inner leg by way of a second loop at said double-loop end, said first outer leg coupled to said second outer leg by way of said cross member at said closed end, said first inner leg being spaced apart from said second inner leg to define a gap therebetween;

a spring arm attached at an anchor point to at least one of said first inner leg and said second inner leg; and a tab extending from said spring arm and protruding through said gap at a stress point to force said first inner leg and said second inner leg further apart than they would otherwise be in an unstressed state, thereby predictably distorting said sheet metal spring member to provide a predetermined spring response, said anchor point being spaced apart from said stress point said tab and said spring arm being integrally formed as a one-piece unit.

2. The auto-snap device of claim 1, wherein said cross member is closer to said stress point than said anchor point.

3. The auto-snap device of claim 1, wherein said spring arm is made of sheet metal.

4. The auto-snap device of claim 3, further comprising a crease where said tab extends from said spring arm.

5. The auto snap device of claim 1, further comprising: an actuator engaging said sheet metal spring member; a first contact; and a second contact conductively bonded to said sheet metal spring member and selectively engaging said first contact in response to movement of said actuator to provide a SPST switch.

6. The auto-snap device of claim 5, further comprising: a second sheet metal spring member engaging said actuator; a third contact; and a fourth contact conductively bonded to said second sheet metal spring member and selectively engaging said third contact in response to movement of said actuator to provide a DPST switch.

7. The auto-snap device of claim 5 further comprising a third contact with said second contact selectively and alternately engaging said first contact and said third contact in response to movement of said actuator to provide a SPDT switch.

8. The auto-snap device of claim 7, further comprising a second sheet metal spring member engaging said actuator; a fourth contact; a fifth contact; and a sixth contact conductively bonded to said second sheet metal spring member, said sixth contact selectively and alternately engaging said fourth contact and said fifth contact in response to movement of said actuator to provide a DPDT switch.

9. The auto-snap device of claim 1 wherein said first inner leg and said second inner leg define a recess at said gap to position said tab at said stress point.

10. The auto-snap device of claim 1 further comprising one rib disposed along said first outer leg and a second rib disposed along said second outer leg.

11. An auto-snap device, comprising:

a sheet metal spring member having a double-loop end opposite a closed end, said spring member having a first outer leg, a second outer leg, a first inner leg, a second inner leg, and a cross member, said first outer leg coupled to said first inner leg by way of a first loop at said double-loop end, said second outer leg coupled to said second inner leg by way of a second loop at said double-loop end, said first outer leg coupled to said second outer leg by way of said cross member at said closed end, said first inner leg being spaced apart from said second inner leg to define a gap therebetween;

a spring arm attached at an anchor point to at least one of said first inner leg and said second inner leg;

a tab integrally joined to said spring arm and protruding through said gap at a stress point to force said first inner leg and said second inner leg further apart than they would otherwise be in an unstressed state, thereby predictably distorting said sheet metal spring member to provide a predetermined spring response, said cross member being closer to said stress point than said anchor point;

an actuator engaging said sheet metal spring member;

a first contact; and a second contact conductively bonded to said sheet metal spring member and selectively engaging said first contact in response to movement of said actuator.

12. The auto-snap device of claim 11 wherein said spring arm is made of sheet metal.

13. The auto-snap device of claim 11 further comprising a third contact with said second contact selectively and alternately engaging said first contact and said second contact in response to movement of said actuator to provide a SPDT switch.

14. The auto-snap device of claim 11 further comprising a second sheet metal spring member engaging said actuator; a fourth contact; a fifth contact; and a sixth contact conductively bonded to said second sheet metal spring member, said sixth contact selectively and alternately engaging said fourth contact and said fifth contact in response to movement of said actuator to provide a DPDT switch.

15. The auto-snap device of claim 11 wherein said spring arm is attached to said sheet metal spring member at said anchor point by way of a rivet.

16. The auto-snap device of claim 11, wherein said spring arm is welded to said sheet metal spring member at said anchor point.

17. An auto-snap device, comprising:

a sheet metal spring member having a double-loop end opposite a closed end, said spring member having a first outer leg, a second outer leg, a first inner leg, a second inner leg, and a cross member, said first outer leg coupled to said first inner leg by way of a first loop at said double-loop end, said second outer leg coupled to said second inner leg by way of a second loop at said double-loop end, said first outer leg coupled to said second outer leg by way of said cross member at said closed end, said first inner leg being spaced apart from said second inner leg to define a gap therebetween;

a spring arm made of sheet metal attached at an anchor point to at least one of said first inner leg and said second inner leg;

a tab integrally joined to said spring arm and protruding through said gap at a stress point to force said first inner leg and said second inner leg further apart than they would otherwise be in an unstressed state, thereby predictably distorting said sheet metal spring member to provide a predetermined spring response, said cross member being closer to said stress point than said anchor point;

an actuator engaging said sheet metal spring member;

a first contact; and a second contact conductively bonded to said sheet metal spring member and selectively engaging said first contact in response to movement of said actuator.

18. The auto-snap device of claim 17 wherein said spring arm is welded to said sheet metal spring member at said anchor point.

* * * * *